US006008715A

United States Patent [19]

Gottfried et al.

[11] Patent Number: 6,008,715

[45] Date of Patent: Dec. 28, 1999

[54] ELECTRO-STATIC DISCHARGE (ESD) HARDENED FUSE

[75] Inventors: Noah L. Gottfried, Johnsonburg, N.J.; David John Pongracz, Bangor; Steven J. Smith, Milford, both of Pa.

[73] Assignee: Lucent Technologies Inc., Murray Hill, N.J.

[21] Appl. No.: 09/215,724

[22] Filed: Dec. 18, 1998

[51] Int. Cl.[6] ..... H01H 85/30; H01H 85/165

[52] U.S. Cl. ..... 337/244; 337/241; 337/265; 337/267; 337/248

[58] Field of Search ..... 337/229, 241, 337/242, 243, 244, 265, 266, 267, 246, 248

[56] References Cited

U.S. PATENT DOCUMENTS

| | | | |
|---|---|---|---|
| 817,959 | 4/1906 | Craft | 337/219 |
| 3,190,987 | 6/1965 | Fister | 337/261 |
| 3,538,480 | 11/1970 | Urani | 337/187 |
| 4,365,226 | 12/1982 | Barry et al. | 337/198 |
| 4,496,929 | 1/1985 | Urani | 337/265 |
| 4,544,907 | 10/1985 | Takano | 337/262 |
| 5,276,422 | 1/1994 | Ikeda et al. | 337/28 |

FOREIGN PATENT DOCUMENTS

| | | | |
|---|---|---|---|
| 407094372A | 4/1995 | Japan | H01G 9/12 |

*Primary Examiner*—Leo P. Picard
*Assistant Examiner*—Anatoly Vortman

[57] ABSTRACT

A fuse for interfacing electrical current with electronic components and for shielding the electronic components from potentially damaging electrostatic discharge. The fuse includes a fuse body having an edge and first and second electrical contacts. A fuse indicator is connected to one electrical contact and a fuse element extends between the indicator and the other contact for providing a conduit for operating current to reach the interfaced electronic components. A window is disposed on the edge of the fuse body and positioned over the fuse indicator. Sealant is disposed between the window edge and the fuse body edge to prevent the accumulation of air therebetween and, thereby, preventing such accumulated air from functioning as a transmission medium through which an electrostatic discharge can travel and reach the electronic components.

9 Claims, 2 Drawing Sheets

ELECTRO-STATIC DISCHARGE (ESD) HARDENED FUSE

BACKGROUND OF THE INVENTION

1. Field of the Invention

The present invention is directed to electronic circuitry protection devices. More particular, the present invention pertains to a fuse for interfacing a power source with components on a printed wiring board while protecting the components from electrostatic discharges.

2. Description of the Related Art

Protection devices such as fuses are well known and are used to safeguard electrical equipment from current surges delivered by a power source. Such fuses are typically connected between a power source and the electrical equipment and become open circuits when a current surge predeterminantly exceeding the maximum current rating of the fuse is received. Fuses may also be exposed to voltage surges such as electrostatic discharges or arcs that are often generated when electrical equipment is touched by, for example, a person.

As is known in the art, when voltage spikes, in general, and electrostatic discharges in particular are generated, the spikes will travel along a path of least resistance. Fuses are designed with this principle in mind to allow a generated spike to be discharged without damaging the electrical equipment interfaced with the fuse, i.e. to provide a low resistance path to common ground. Because electrostatic shocks are fairly common, such as those caused by human interaction with electronic equipment, such equipment as well as the fuses connected thereto must be tested to determine whether they can withstand such voltage spikes.

For example, in the telecommunications industry miniature fuses are commonly used to interface power supplies with electrical components mounted to a printed wiring board. Specifically, each fuse seats within a fuse holder connected to the printed wiring board and consists of a fuse body, typically of plastic material, to which a fuse element and a fuse indicator are connected. A transparent indicator window is positioned over the fuse indicator and is friction-fitted to the fuse body.

Prior to commercial use, telecommunications equipment as well as the fuses through which power is supplied thereto are administered an electrostatic discharge test to determine whether the equipment meets predetermined standards in the industry or otherwise dictated by manufacturer or user demands. Such tests are administered by applying electrostatic shocks of approximately 15 KV to various regions of the devices under test. For example, as a part of such testing, electrostatic shocks are applied to various regions of the fuses such as the fuse holder and fuse window to determine whether the shocks are safely discharged or dissipated, e.g. to ground, without damaging the electrical components connected to the fuse. When the test is administered to the fuse holder, the shock is typically discharged without damaging the electrical components. However, when the test is administered to the fuse window or to the fuse body of currently utilized fuses at a location proximate the fuse window, an air gap inherently present between the window and body serves as a conduit which detrimentally directs the shock to the fuse element and, consequently, to the electronic equipment. The result, of course, is equipment damage.

Prior art techniques employed to alleviate this problem involve placing a small metal door or panel in close proximity to the window to provide a discharge path for the arc. Such a technique, however, is costly, burdensome and obstructs the view of the fuse indicator, thus making difficult visual inspection of the condition of the fuse.

SUMMARY OF THE INVENTION

In accordance with the present invention, an electrostatic discharge fuse is disclosed for providing operating voltage to electronic components while protecting the components from electrostatic discharge voltage arcs. The inventive fuse includes a fuse body to which a fuse element and a fuse indicator are attached. The fuse indicator provides visual display of the condition of the fuse element so that, upon visual inspection, a damaged fuse can be replaced. A generally transparent indicator window is disposed over a portion of the fuse indicator and is coupled or attached to a region of the fuse body. A sealant is disposed between the window and the body within the region to prevent air from collecting or remaining within the region, the presence of which would provide a path along which a voltage arc could travel across the fuse element and likely damage connected electronic components.

In a preferred embodiment, the region of the fuse body defines a groove or channel in which an engaging edge of the window is seated. In another preferred embodiment, the sealant is a pigmented adhesive substance for facilitating securement of the window to the fuse body region while providing for ready visual inspection of the adhesive.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings wherein like reference characters denote similar elements throughout the views.

DETAILED DESCRIPTION OF THE PRESENTLY PREFERRED EMBODIMENTS

Figure 1:
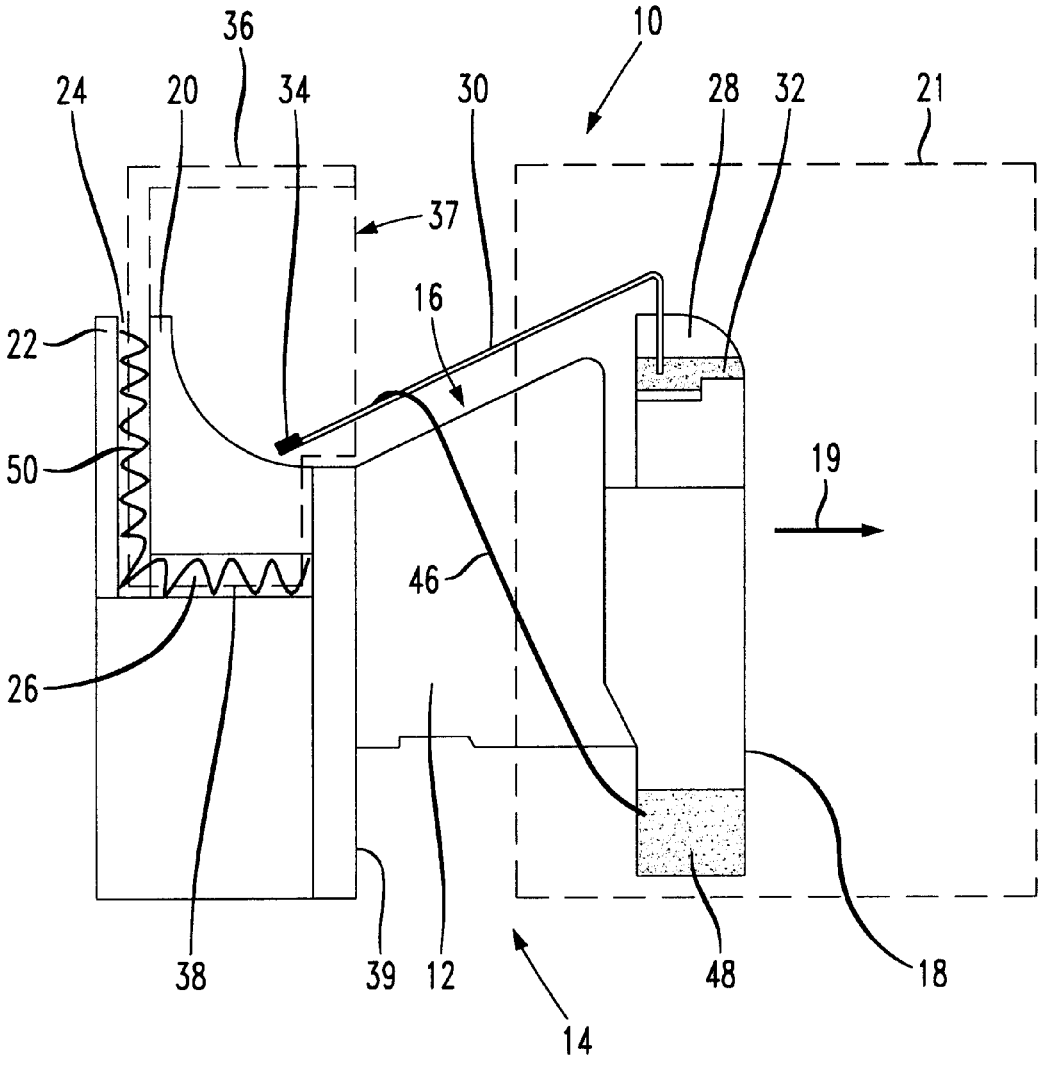
FIG. 1 is a plan view of an electrostatic discharge fuse in accordance with a preferred embodiment of the present invention.
Figure 2:
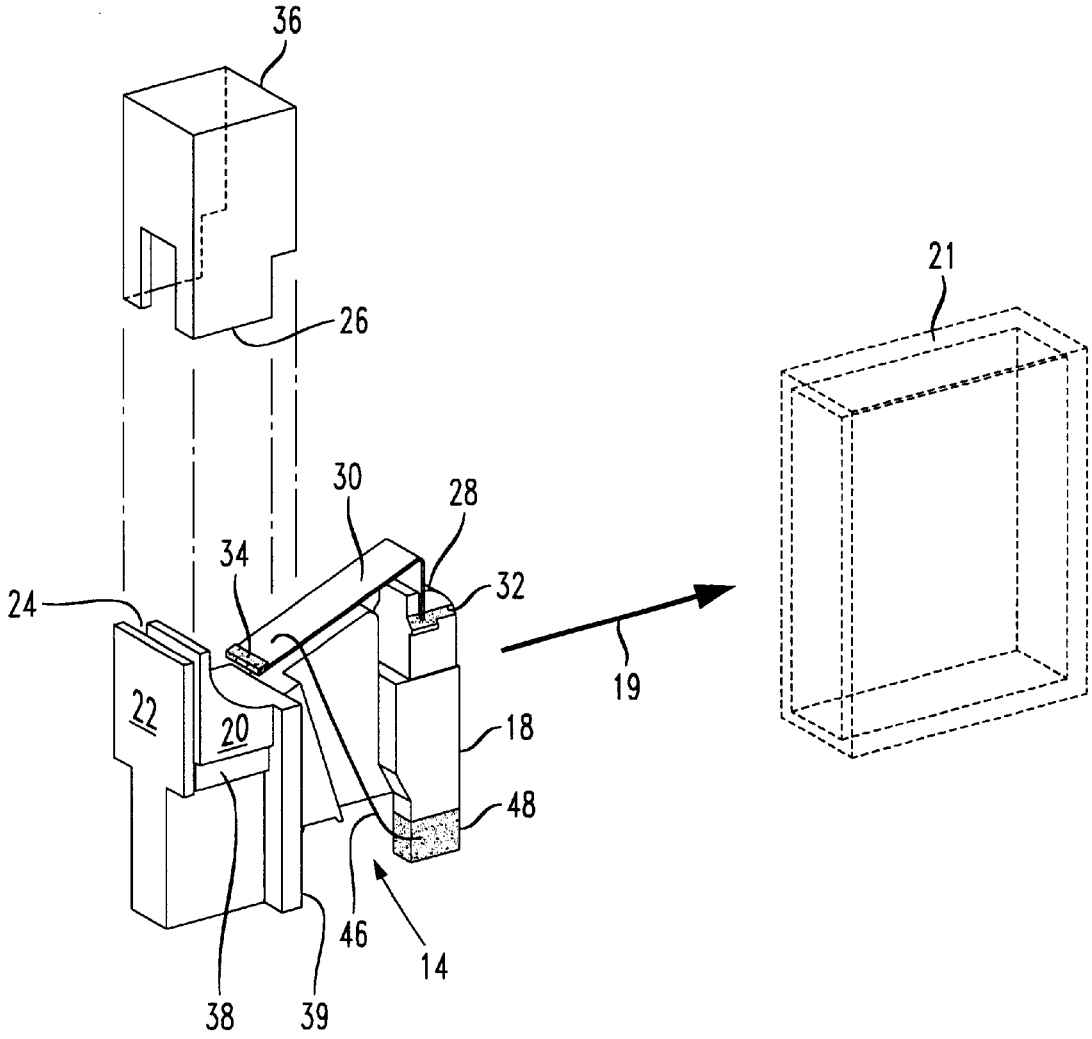
FIG. 2 is an exploded perspective view of the fuse of FIG. 1.

Turning now to the FIGS. 1 and 2, an electrostatic discharge fuse 10 in accordance with a preferred embodiment of the present invention is shown. As is known in the art, the fuse 10 interfaces with and seats within a fuse holder 21 (shown in phantom), typically mounted on or to a printed wiring board. The fuse provides an interruptible path for the supply of operating power to electronic components connected to the printed wiring board and sets a predetermined maximum threshold current level so as to prevent current above the maximum threshold from reaching and damaging the electronic components. The fuse 10 includes a body 12 having a first contoured edge or side 14, a second contoured edge 16 and a base 18 which engage the sides of the fuse holder when fuse 10 is disposed therein, generally by displacing the fuse in the direction of arrow 19 to insert it into the fuse holder 21. The fuse body 12 is typically molded from a non-conducting material, such as plastic, and although the fuse body is depicted as having contoured edges, other fuse body configurations may be employed without departing from the spirit and scope of the present invention.

The second contoured edge 16 has a first peak 20 and a second peak 22 which are spaced from each other to define a channel 24 formed therebetween. A ridge or groove 26 is formed on a surface of the body 12 proximate the first peak 20, as shown in the figures, and a third peak is formed on the body 12 proximate base 18 and serves as a fuse anchor 28 to which a conducting material 32 is secured. The conducting material is preferably configured as a band or collar disposed about and affixed to the anchor 28 to define an electrical contact through which operating current is supplied to the electronic components interfaced with the fuse 10 when the fuse is fully seated in the fuse holder as more fully explained below.

With continued reference to the figures, a fuse indicator 30 extends between the first peak 20 and the fuse anchor 28 and is electrically connected to collar 32, such as with solder. The other end of indicator 30 has an indicator element 34 disposed at or in close proximity to peak 20. Indicator element 34 contains a pigmented material that provides a visual signal when the fuse 10 is damaged or "blown".

An indicator window 36 is positioned over the first peak 20 and over the indicator element 34. In the preferred embodiment, the indicator window 36 is substantially rectangularly shaped and is formed of a generally transparent non-conductive material, such as plastic. Window 36 has an open side 37 and seats about peak 20 within channel 24 so that indicator element 34 is contained within window 36. When so-positioned, an engaging edge 38 of window 36 seats within the ridge 26 defined on the surface of fuse body 12 to form, for example, a snap-fit arrangement between window 36 and fuse body 12. To operatively seat the fuse 10 in a fuse holder, in accordance with the present invention, base 18 of the fuse body is advanced into the fuse holder in the direction of arrow 19 until window edge 37 and an extension 39 formed on side 14 of the fuse body 12 abut and rest upon opposite edges or lips of the fuse holder 21. In this position, the indicator element 34 is inaccessible to a user but allows the user to visually inspect the indicator element 34 through the transparent window 36.

An elongated fuse element 46 is connected at one end to fuse indicator 30, spaced from indicator element 34, and at its other end to a conductive material formed, for example, as a collar 48 disposed about a portion of side 14 proximate base 18, as shown to form a second electrical contact of the fuse 10. As is known in the art, fuse 46 provides a conduit for current generated by a power source (not shown) or otherwise directed to electrical components connected to the fuse 10. For example, when fuse 10 is operatively seated in a fuse holder, collar 32 interfaces with a connection lead from a current or power source and fuse collar 48 interfaces with connecting leads for providing the electrical power or current to electronic components of the fused electrical circuit. Generated current thus flows through fuse element 46 to fuse collar 48 and to the electronic components connected to fuse collar 48. In the event that an electrical current predeterminantly exceeding the arnp rating of the fuse element 46 is received or present at collar 32, fuse element 46 will become open circuited or "blow", as known in the art, to prevent such current from travelling to and reaching the electronic components.

Fuses for use in various applications and, in particular, in the telecommunications industry, are often exposed to electrostatic discharges or "shocks" that may result when a user touches or contacts the exposed regions of the fuses. Such a discharge generates a voltage arc which, if not properly discharged, can cause damage to the electronic components connected to the fuse. For this reason, testing regulations have been adopted and employed for electronic components and fuses to ensure that any such electrostatic discharge will not adversely affect the electronic components. In the case of the fuse 10, for example, any electrostatic discharge applied to the fuse must be dissipated, such as by routing the discharge to common ground or the like, without allowing the discharge to reach and damage the electronic components interfaced with the fuse 10. If the electrostatic discharge is applied to the window 36 or the exposed portions of the fuse body 12 when the fuse 10 is positioned operatively within a fuse holder on a circuit board, an electrostatic discharge may be conveyed or carried over to the fuse element 46 which, in turn, would provide a path for the voltage surge to the electronic equipment, with likely damage to the equipment. Such a circumstance arises when air is present within channel 24 or ridge 26 i.e. at the interface between window 36 and fuse body 12. In such an event the air provides a transmission medium through which the electrostatic discharge arc travels to the fuse element 46 via fuse indicator 30.

To alleviate this threat, in accordance with the present invention a sealant 50 is provided within ridge 26 to prevent air from accumulating between the engaging edge 38 of indicator window 36 and the fuse body 12. The sealant 50 can be any substance so long as it serves its intended purpose, namely to prevent the accumulation or presence of air between the interface of window 36 and fuse body 12. Accordingly, the sealant may be disposed along or within the entire channel 24 or only along a thin edge or line of the channel to provide an air-tight seal between window 36 and body 12. In a preferred embodiment, the sealant is a non-conducting substance and, in particular, an adhesive material such as an epoxy, for permanently affixing the window 36 to the body 12 and that substantially fills the space defining the interface proximate ridge 26. In the most preferred embodiment, the sealant is pigmuented so as to have copacity and/or coloration that will permit or facilitate ready detection of the sealant when the fuse 10 is visibly inspected. In a most preferred embodiment, the sealant is also provided within channel 24.

While the fundamental novel features of the invention as applied to the preferred embodiments thereof have been shown, described and pointed out, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, although the invention has been described herein in the context of a miniature fuse of the type commonly used in telecommunications equipment, the invention may be employed in or applied to any type of fuse having an indicator window and which is susceptible to electrostatic discharge. It is the intention, therefore, to be limited only as indicated by the scope of the claims appended hereto.

We claim:

1. An electrostatic discharge fuse for directing, through the fuse, operating current to electronic components while protecting the electronic components from electrostatic discharges, comprising:

a fuse body having an edge and first and second electrical contacts, said body being configured for interfacing said first electrical contact with a source of the operating current and said second electrical contact with the electronic components;

a fuse indicator connected at a first end to said first electrical contact for receiving the operating current, said fuse indicator being disposed at a second end to a region of said edge;

a fuse element extending between said fuse indicator and said second electrical contact for carrying the operating current between said first and said second electrical contacts;

a substantially transparent window disposed on said edge of said body over said region for containing said second end of said fuse indicator, enabling visual inspection of said second end of said fuse indicator through said window, said window having an engaging edge that engages said fuse body edge; and a sealant disposed at an interface defined between said window engaging edge and said region of said edge of said body preventing presence of air at said interface between said window engaging edge and said body edge so as to avoid electrostatic discharges through said interface and likely resulting in damage to the electronic components.

2. The fuse of claim 1, wherein said region of said edge has a groove formed therein and wherein said window engaging edge seats within said groove.

3. The fuse of claim 1, wherein said sealant comprises an adhesive to fixedly secure said window engaging edge to said region.

4. The fuse of claim 3, wherein said adhesive contains an opaque pigment to facilitate visual inspection of said adhesive.

5. The fuse of claim 2, wherein said fuse body edge has two spaced-apart peaks defining a channel therebetween, said window having a sidewall that seats within said channel when said window is disposed on said fuse body edge.

6. The fuse of claim 5, wherein said sealant is futer disposed between said window sidewall and said fuse body.

7. An electrostatic discharge fuse for directing, through the fuse, electrical current to interfaced electronic components while protecting the electronic components from electrostatic discharges, comprising:

a fuse body having first and second electrical contacts for respective connection to a source of the electrical current and to the interfaced electronic components, and a fuse body receiving edge;

a fuse indicator connected between one of the first and second electrical contacts at a location on the fuse body proximate said fuse body receiving edge;

a fuse element connected between said fuse indicator and the other of said first and second electrical contacts for carrying the electrical current between the source and the electronic components;

a substantially transparent window element having an engagement edge and disposed on the fuse body so that said engaging edge substantially abuts said fuse body receiving edge, said window element defining a cavity within which said fuse indicator proximate said fuse body receiving edge is disposed so that said fuse indicator proximate said fuse body is visible through said substantially transparent window element to enable user assessment of a condition of the fuse indicator; and a sealant disposed at said substantial abutment of said engaging edge and said fuse body receiving edge so as to define a continuous seal therebetween and thereby prevent development and presence of an electrostatic discharge-conducting air communication path between said engagement edge and said fuse body receiving edge.

8. The fuse of claim 7, wherein said sealant comprises an adhesive to fixedly secure said window engaging edge to said region.

9. The fuse of claim 8, wherein said adhesive contains an opaque pigment to facilitate visual inspection of said adhesive.

* * * * *